US010698357B2

(12) United States Patent
Imaizumi et al.

(10) Patent No.: US 10,698,357 B2
(45) Date of Patent: Jun. 30, 2020

(54) IMAGE FORMING APPARATUS IN WHICH COST OF COMPONENT AND ASSEMBLING CAUSED BY SORTING WORK IS REDUCED BY PROVIDING ELECTRICALLY CONDUCTIVE WIRE FORMED OF MATERIAL HAVING ELASTIC COEFFICIENT LOWER THAN FIRST AND SECOND URGING MEMBERS

(71) Applicant: CANON KABUSHIKI KAISHA, Tokyo (JP)

(72) Inventors: Chikara Imaizumi, Numazu (JP); Kazuhiko Shinoda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/528,393

(22) Filed: Jul. 31, 2019

(65) Prior Publication Data

US 2019/0354059 A1 Nov. 21, 2019

Related U.S. Application Data

(63) Continuation of application No. 16/031,904, filed on Jul. 10, 2018, now Pat. No. 10,409,213, which is a (Continued)

(30) Foreign Application Priority Data

Apr. 22, 2016 (JP) ..... 2016-086061

(51) Int. Cl.

| | |
|---|---|
| ***G03G 15/00*** | (2006.01) |
| ***G03G 21/16*** | (2006.01) |
| ***G03G 15/02*** | (2006.01) |

(52) U.S. Cl.
CPC ..... *G03G 15/80* (2013.01); *G03G 15/0233* (2013.01); *G03G 21/1652* (2013.01)

(58) Field of Classification Search
CPC ..... G03G 15/80; G03G 21/1652
(Continued)

(56) References Cited

U.S. PATENT DOCUMENTS

| | | | | |
|---|---|---|---|---|
| 10,042,312 | B2 * | 8/2018 | Imaizumi et al. | G03G 15/80 |
| 10,409,213 | B2 * | 9/2019 | Imaizumi et al. | G03G 15/80 |

FOREIGN PATENT DOCUMENTS

| | | | |
|---|---|---|---|
| JP | S57-005386 | A | 1/1982 |
| JP | 2015-135417 | A | 7/2015 |
| JP | 2016-012065 | A | 1/2016 |

* cited by examiner

*Primary Examiner* — William J Royer
(74) *Attorney, Agent, or Firm* — Canon U.S.A., Inc. IP Division

(57) ABSTRACT

An image forming apparatus arranged to form an image on a recording material, the image forming apparatus includes a first and second object. A first urging member is provided between the electrically conductive wire, and arranged to urge towards the first object and to electrically couple the electrically conductive wire and the first object to each other. A second urging member is provided between the second object and the electrically conductive wire, and arranged to urge towards the second object and to electrically couple the electrically conductive wire and the second object to each other. The electrically conductive wire is formed of a material having an elastic coefficient that is lower than that of the first urging member and that of the second urging member.

21 Claims, 14 Drawing Sheets

Related U.S. Application Data continuation of application No. 15/491,814, filed on Apr. 19, 2017, now Pat. No. 10,042,312.

(58) Field of Classification Search
USPC ..... 399/88, 90
See application file for complete search history.

IMAGE FORMING APPARATUS IN WHICH COST OF COMPONENT AND ASSEMBLING CAUSED BY SORTING WORK IS REDUCED BY PROVIDING ELECTRICALLY CONDUCTIVE WIRE FORMED OF MATERIAL HAVING ELASTIC COEFFICIENT LOWER THAN FIRST AND SECOND URGING MEMBERS

CROSS REFERENCE TO RELATED APPLICATIONS

The present application is a continuation of U.S. patent application Ser. No. 16/031,904, filed Jul. 10, 2018, which is a continuation of U.S. patent application Ser. No. 15/491,814, filed Apr. 19, 2017 and issued as U.S. Pat. No. 10,042,312 on Aug. 7, 2018, which claims the benefit of Japanese Patent Application No. 2016-086061, filed Apr. 22, 2016, all of which are hereby incorporated by reference herein in their entirety.

BACKGROUND OF THE INVENTION

Field of the Invention

The present disclosure relates to an image forming apparatus, such as a copying machine and a printer, employing an electrophotographic recording technology.

Description of the Related Art

An image forming apparatus, such as a laser beam printer, includes a charging device, a developing device, a transfer device, and a fixing device. A few hundred to a few thousand volts are applied to power supply target portions of the charging device, the developing device, the transfer device, and other devices. In order to apply a high voltage to the power supply target portions, the image forming apparatus includes a high voltage power supply board that has a high voltage power supply circuit that generates a high voltage on a printed board.

Typically, the high voltage power supply board and the power supply target portions are connected with high-voltage cables in order to apply the high voltage generated in the high voltage power supply board to the power supply target portions. However, since high-voltage cables do no easily flex, the ease of assembly is poor and, furthermore, it is costly. Accordingly, Japanese Patent Laid-Open No. 2008-242070 proposes a method in which the high voltage power supply board, and the charging device and the like are connected to each other with a wire formed by bending a steel material such as stainless steel.

However, the paths to the power supply target portions of the charging device, the developing device, the transfer device, and the like are each different. Accordingly, a steel material having a different shape needs to be prepared for each path, such that the type of components disadvantageously increases. Furthermore, sorting work needs to be done in order to prevent the steel materials from becoming mixed during assembly work.

SUMMARY OF THE INVENTION

The present disclosure has been made to overcome the above problems and provides an image forming apparatus that is capable of reducing the component cost and the assembling cost due to the sorting work by reducing the type of components.

The present disclosure provides an image forming apparatus including an object, an electrically conductive member, and an urging member arranged to urge the electrically conductive member towards the object and to electrically couple the electrically conductive member and the object to each other, in which the electrically conductive member does not have any insulating cover and is formed of a material having an elastic coefficient that is lower than that of the urging member.

The present disclosure provides another image forming apparatus including an object, an electrically conductive member, and an urging member arranged to urge towards the object and to electrically couple the electrically conductive member and the object to each other, in which the electrically conductive member does not have any insulating cover and is formed of a material having a yield stress that is lower than that of the urging member.

The present disclosure provides another image forming apparatus including an object, an electrically conductive member, and an urging member arranged to urge towards the object and to electrically couple the electrically conductive member and the object to each other, in which the electrically conductive member does not have any insulating cover and is formed of a material having a yield strength that is lower than that of the urging member.

Further features of the present invention will become apparent from the following description of exemplary embodiments with reference to the attached drawings.

DESCRIPTION OF THE EMBODIMENTS

First Exemplary Embodiment

Figure 1:
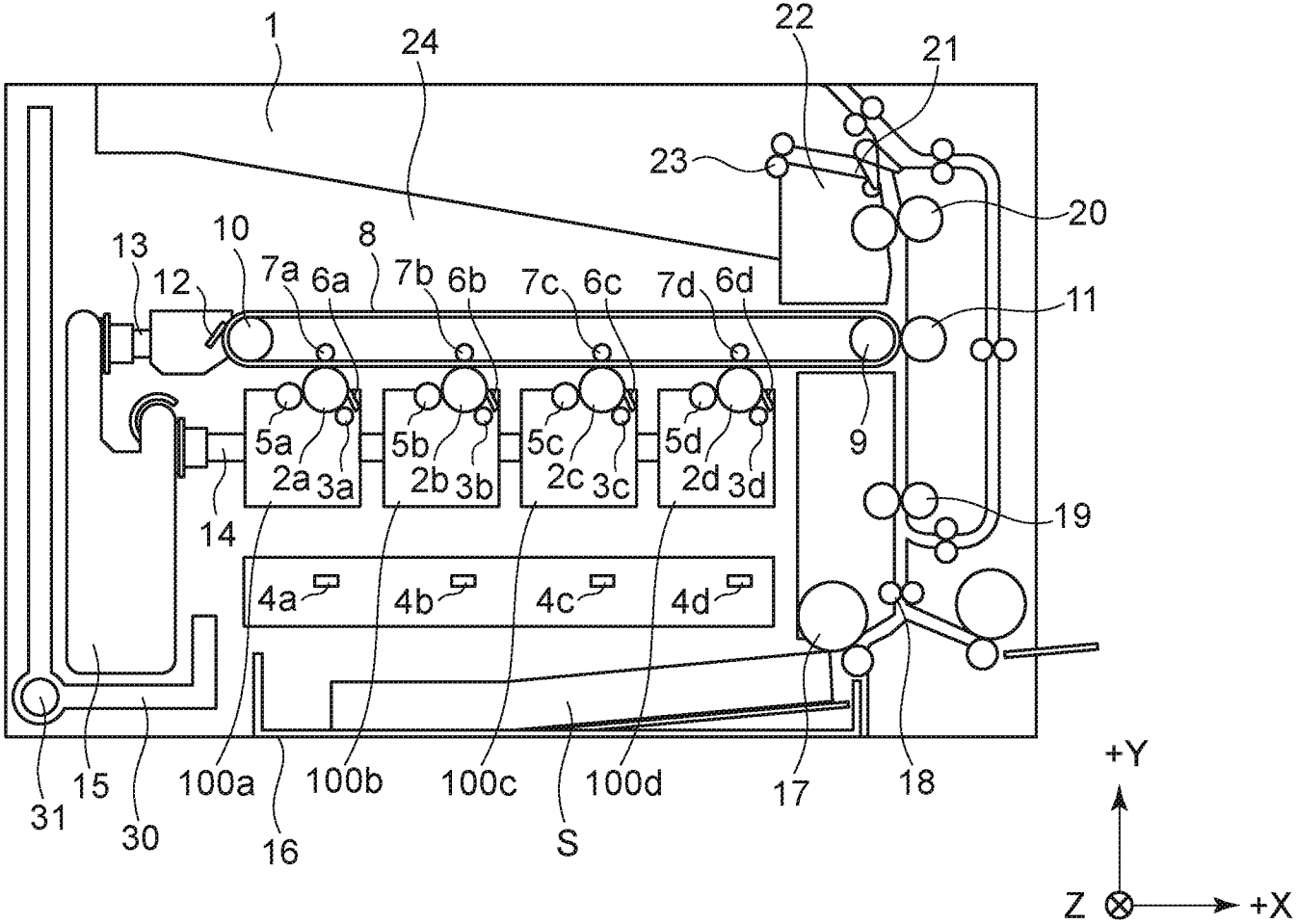
FIG. 1 is a cross-sectional view of an image forming apparatus.

FIG. 1 is a cross-sectional view of a full color printer (an image forming apparatus) adopting an electrophotographic printing method. Reference numeral 1 is a main body of the image forming apparatus. Four drum-shaped photosensitive members 2*a*, 2*b*, 2*c*, and 2*d* are provided inside the main body 1. Note that when referring to one or all of the four photosensitive members 2*a*, 2*b*, 2*c*, and 2*d*, the one or all of the four photosensitive members 2*a*, 2*b*, 2*c*, and 2*d* will be referred to as a photosensitive member 2 or photosensitive members 2. The other members described below will be described in a similar manner. Charging units 3*a*, 3*b*, 3*c*, and 3*d* (hereinafter, referred to as charging units 3) that charge the surfaces of the photosensitive members 2 are provided inside the main body 1. Furthermore, scanner units 4*a*, 4*b*, 4*c*, and 4*d* (hereinafter, referred to as scanner units 4) that scan the surfaces of the photosensitive members 2 with laser beam emitted on the basis of image information are provided. Furthermore, developing units 5*a*, 5*b*, 5*c*, and 5*d* (hereinafter, referred to as developing units 5) that develop electrostatic latent images formed on the surfaces of the photosensitive members 2 with toner are provided. Furthermore, cleaners 6*a*, 6*b*, 6*c*, and 6*d* (hereinafter, referred to as cleaners 6) that clean the surfaces of the photosensitive members 2 are provided. Note that reference numerals 100*a*, 100*b*, 100*c*, and 100*d* are process cartridges (hereinafter, referred to as cartridges 100) that are each a unit of process members, such as the photosensitive member 2 and the charging unit 3, required to form an image. The cartridges 100 are detachable with respect to the main body 1. Each cartridge 100 is a unit of a single photosensitive member 2, a single charging unit 3, a single developing unit 5, and a single cleaner 6.

Reference numeral 8 is an intermediate transfer belt. Primary transfer rollers 7*a*, 7*b*, 7*c*, and 7*d* (hereinafter, referred to as primary transfer rollers 7) are provided in the intermediate transfer belt 8. The primary transfer rollers 7 are urged against the photosensitive members 2 with the intermediate transfer belt 8 in between. Application of a voltage to the primary transfer rollers 7 transfers the toner images on the photosensitive members 2 to the intermediate transfer belt 8.

The intermediate transfer belt 8 is stretched by a drive roller 9 and a tension roller 10, is driven by the drive roller 9, and rotates in the anticlockwise direction. A secondary transfer roller 11 is provided at a position that opposes the drive roller 9 with the intermediate transfer belt 8 in between. The secondary transfer roller 11 transfers the toner images transferred to the intermediate transfer belt 8 to a sheet S. Reference numeral 12 is a blade that cleans the intermediate transfer belt 8, reference numeral 13 is a toner conveying mechanism that conveys the toner removed from the intermediate transfer belt 8 to a toner collecting container 15. Note that reference numeral 14 is a toner conveying mechanism that conveys the toner collected with the cleaners 6 to the toner collecting container 15. Reference numeral 30 is a door that is provided so as to be capable of being opened and closed with respect to the main body 1 about a shaft 31. The toner collecting container 15 is configured so as to be held by the door 30 such that when the door 30 is opened, the toner collecting container 15 also pivots about the shaft 31, allowing the toner collecting container 15 to be replaced.

A sheet supplying cassette 16 is provided at the lowermost portion in the main body 1. After passing between rollers 18, a skew of a sheet (a recording material) S that has been picked up from the cassette 16 with a feed roller 17 is corrected by a pair of registration rollers 19. The toner images are transferred to the sheet S, which has passed through the pair of registration rollers 19, at where the secondary transfer roller 11 is positioned. Reference numeral 20 is a fixing unit that fixes the toner images transferred onto the sheet S to the sheet S. Reference numeral 21 is a flapper that guides the sheet S to a discharge and conveyance path 22 during simplex printing. Reference numeral 23 is a pair of discharge rollers that discharge the sheet S to a sheet discharge tray 24.

Figure 2:
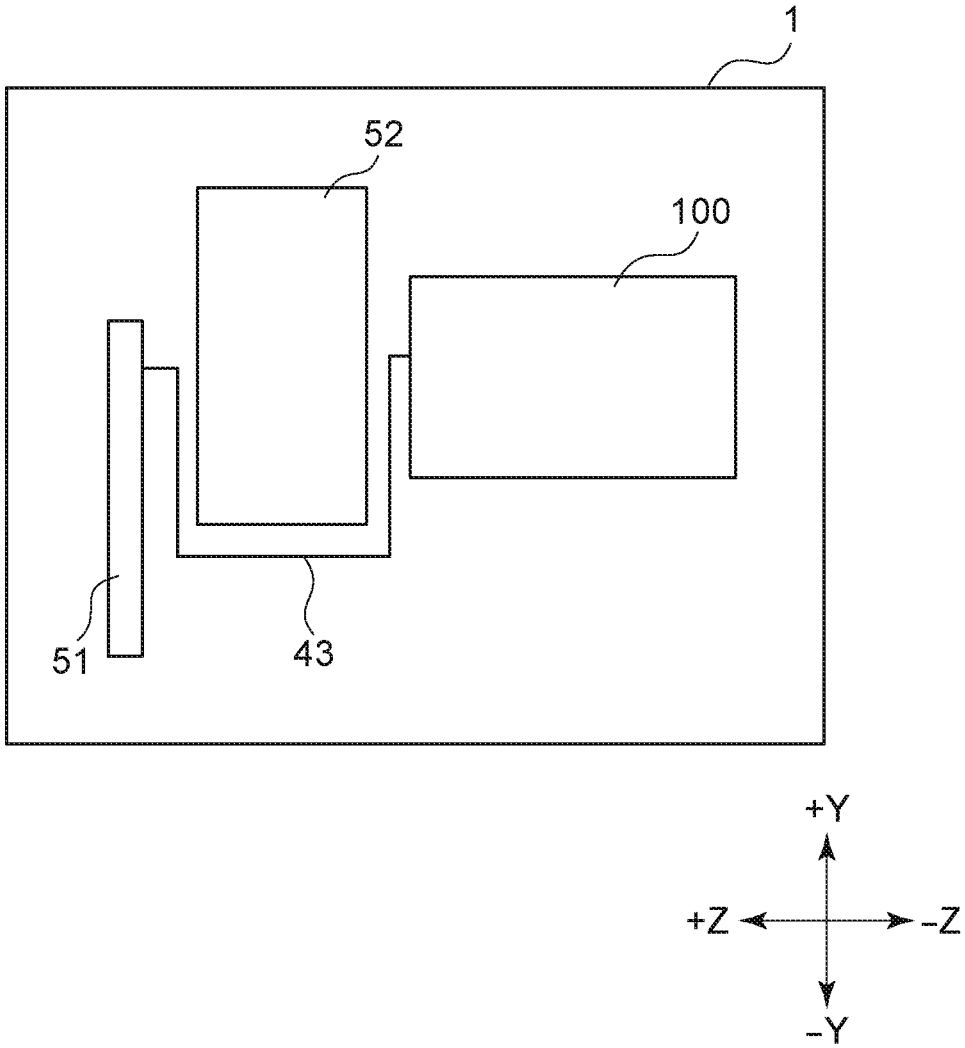
FIG. 2 is a diagram illustrating a configuration of an electrical connection between a printed board and a cartridge.
Figure 3:
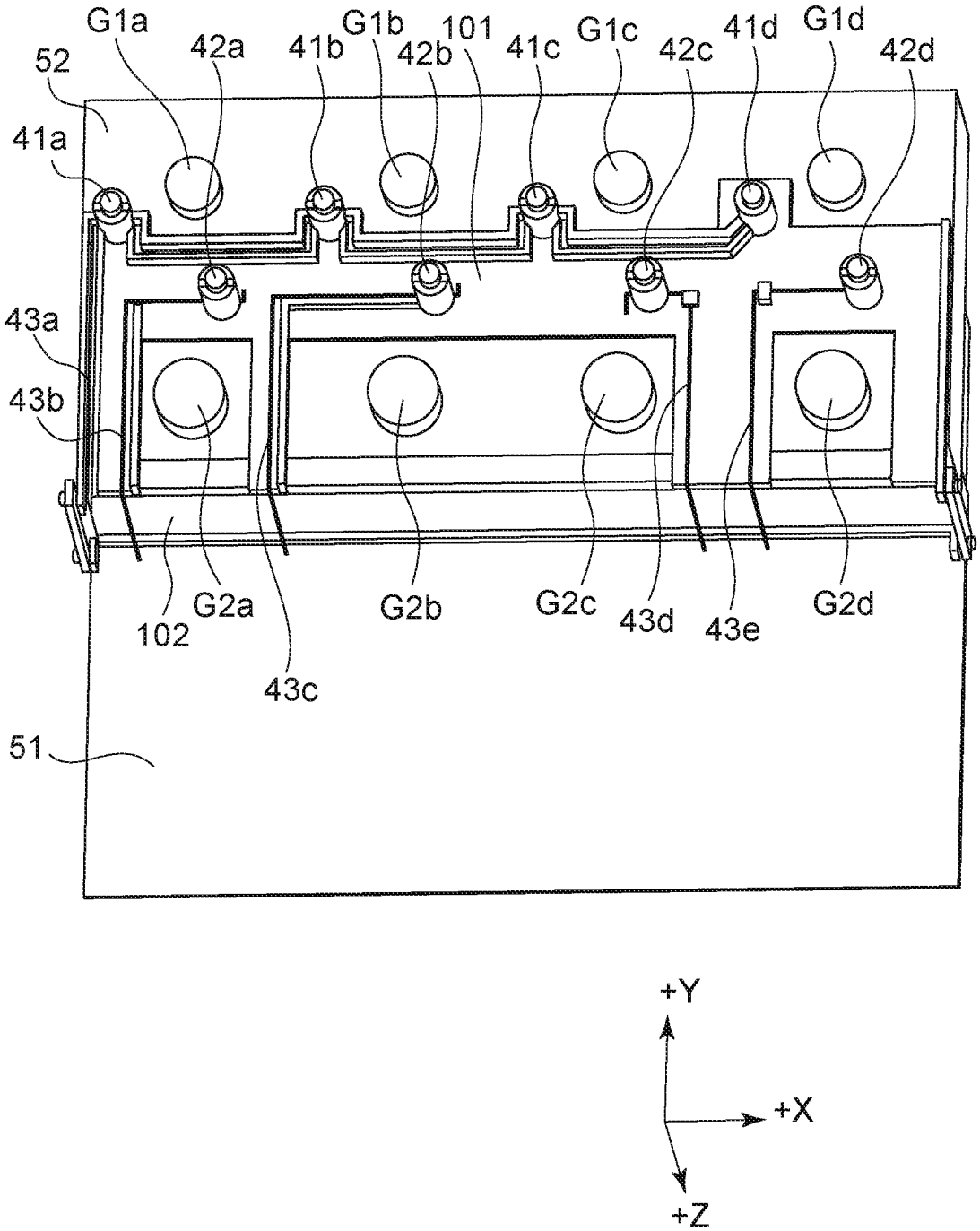
FIG. 3 is a diagram illustrating a configuration of an electrical connection between the printed board and cartridges.
Figure 4:
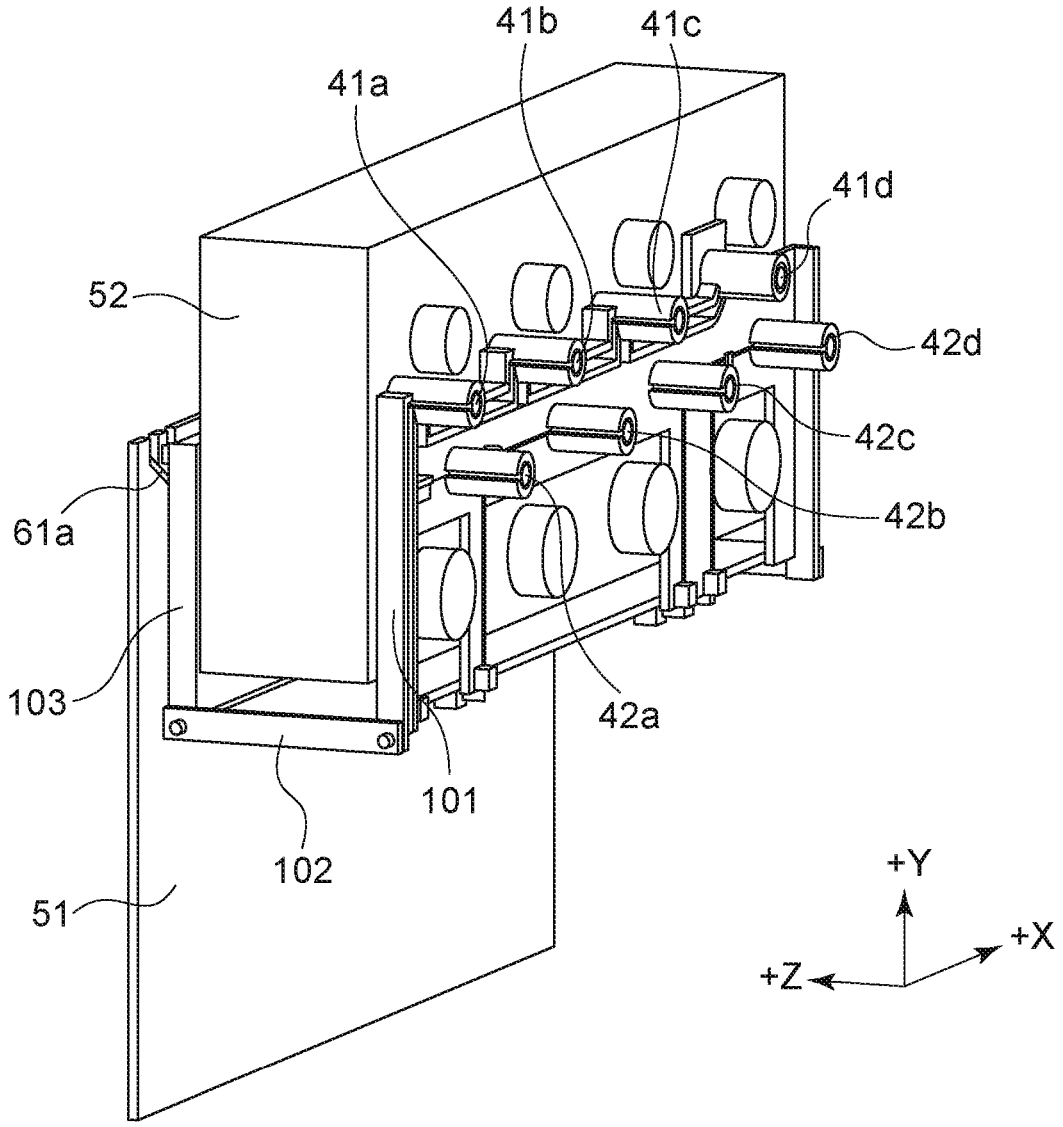
FIG. 4 is a diagram illustrating the configuration of the electrical connection between the printed board and the cartridges.

As illustrated in FIGS. 2 to 4, a drive unit 52 that includes a drive motor and a drive gear, and a printed board 51 that is a high voltage power supply board are provided on the rear side (in a +Z direction) with respect to a space in which the cartridges 100 are accommodated in the main body 1. The drive unit 52 is disposed on the rear side with respect to the printed board 51. A high voltage is applied to the cartridges 100 from the printed board 51. Accordingly, the printed board 51 and the cartridges 100 need to be electrically coupled to each other.

FIGS. 2 to 4 are diagrams illustrating an electrical connection configuration of the printed board 51 that is a connected object requiring an electrical connection and the cartridges 100 that are connected objects requiring electrical connections. A power supply path (a power supply line 43 that is a conductive member) between the printed board 51 to the cartridges 100 first extends from the printed board 51, in a portion between the printed board 51 and the drive unit 52, in a direction (a −Y direction) parallel to the printed board 51. Then, the power supply line 43 passing under the drive unit 52 extends in a direction (a +Y direction) parallel to the printed board 51 once again. Conductive springs 41*a*, 41*b*, 41*c*, and 41*d* (hereinafter, referred to as springs 41 or second springs 41) and conductive springs 42*a*, 42*b*, 42*c*, and 42*d* (hereinafter, referred to as springs 42 or second springs 42) are provided at the end of the power supply path. The springs 41 and the springs 42 are springs that are in contact with electric contacts provided in the cartridges 100. The springs 41 and 42 are provided at the end portion of the power supply line 43 that is a conductive member, and are elastic members that electrically couple the power supply line 43 and the cartridges 100 to each other by urging against the cartridges 100 that are connected objects. In the present exemplary embodiment, compression springs are used as the second springs 41 and 42. As described above, the power supply line 43 is wired so as to bypass the drive unit 52. Note that as described later, elastic members 61 are provided at the end portion of the power supply line 43 that is a conductive member. The elastic members 61 electrically couple the power supply line 43 and the printed board 51 to each other by urging against the printed board 51 that is a connected object.

In FIGS. 3 and 4, reference numerals G1*a* to G1*d*, and G2*a* to G2*d* are couplings provided on the drive unit 52, and the couplings engage with couplings provided on the cartridges 100. Reference numerals G1*a* and G2*a* are couplings corresponding to the cartridge 100*a*. Reference numerals G1*b* and G2*b* are couplings corresponding to the cartridge 100*b*. Reference numerals G1*c* and G2*c* are couplings corresponding to the cartridge 100*c*. Reference numerals G1*d* and G2*d* are couplings corresponding to the cartridge 100*d*. By having the couplings of the drive unit 52 and the couplings of the cartridges 100 engage with each other, drive force can be transmitted from the drive unit 52 to the cartridges 100.

Reference numeral 43*a* is a power supply line from the printed board 51 to the four springs 41. Reference numeral 43*b* is a power supply line from the printed board 51 to the spring 42*a*, reference numeral 43*c* is a power supply line from the printed board 51 to the spring 42*b*, reference numeral 43*d* is a power supply line from the printed board 51 to the spring 42*c*, and reference numeral 43*e* is a power supply line from the printed board 51 to the spring 42*d*. Note that reference numeral 61*a* in FIG. 4 is a spring that electrically connects the power supply line 43*a* and the printed board 51 to each other. Reference numerals 101, 102, and 103 are plates that constitute a holder 300 described later in FIG. 7.

Figure 5:
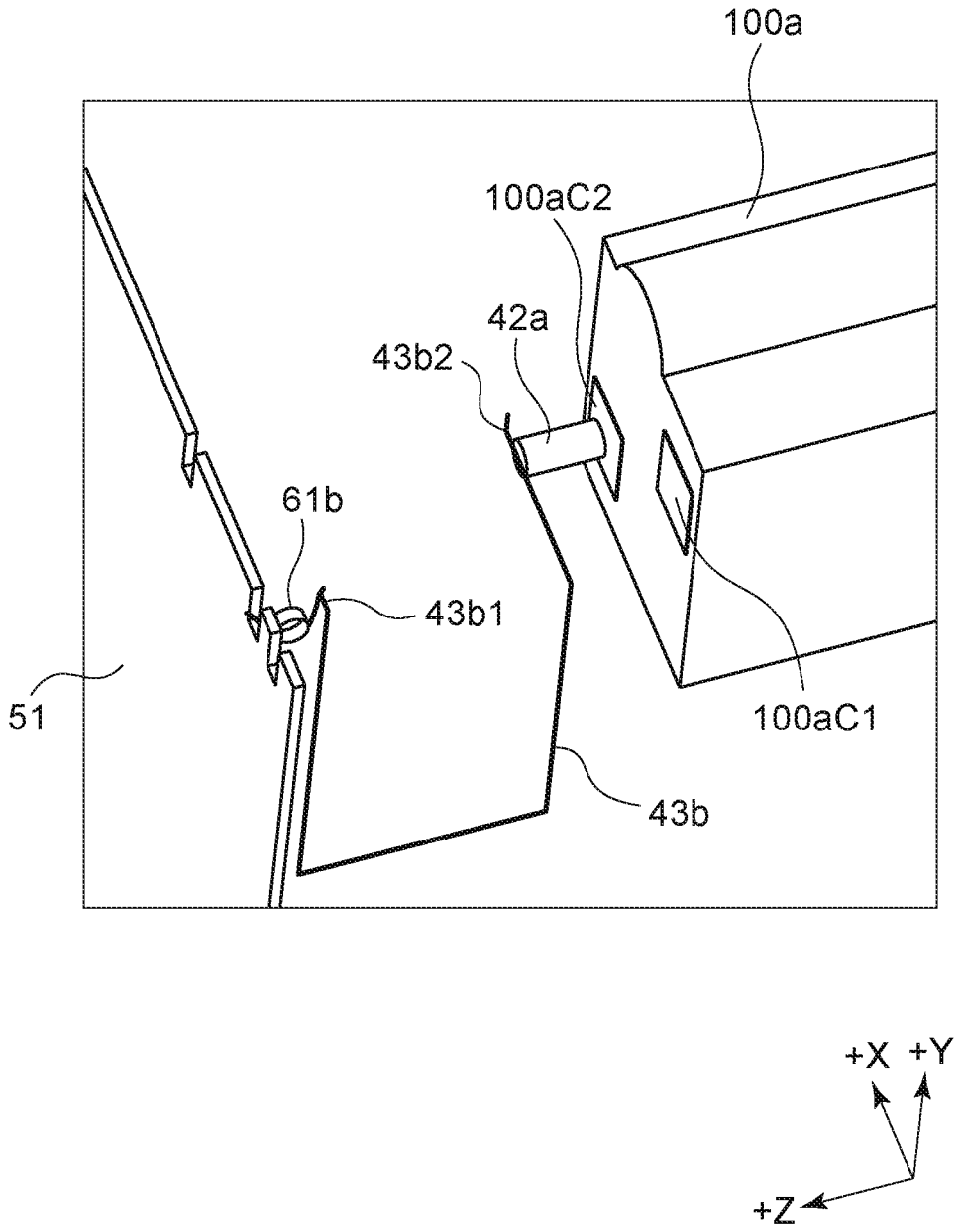
FIG. 5 is a diagram illustrating, among a plurality of power supply paths, a single power supply path.

FIG. 5 is a diagram illustrating one among the plurality of power supply paths stretched from the printed board 51 to the cartridges 100. The printed board 51 and the power supply line 43*b* are electrically connected to each other through a spring 61*b*. In the present exemplary embodiment, a torsion coil spring is used as the spring 61*b*. The spring 61*b* is a first spring that comes into contact with the printed board 51. One end of the spring 61*b* is in contact with a conductor pattern (not shown) provided on the printed board 51, and the other end of the spring 61*b* is in contact with an end portion 43*b*1 of the power supply line 43*b*. The second spring 42*a* is in contact with an end portion 43*b*2 of the power supply line 43*b*. An electric contact 100*a*C2 provided on the cartridge 100*a* is in contact with the spring 42*a*. Reference numeral 100*a*C1 is an electric contact provided on the cartridge 100*a*, and the second spring 41*a* (see FIGS. 3 and 4) is in contact therewith.

The first spring 61*b* and the second spring 42*a* are formed of a wire (a spring steel material, a piano wire, or a stainless steel wire that has a Young's modulus of about 200 GPa, for example) that has a high elastic coefficient and that is generally called a spring material. Meanwhile, the power supply line 43*b* is a wire that is not covered by any insulating cover (a wire in which the conductor is exposed), including plastic or insulating rubber, and is formed of a soft material having a low elastic coefficient (a solder plating annealed copper wire having a Young's modulus of about 100 GPa, for example), a material having a low yield stress, or a material having a low yield strength. As described above, the power supply line 43*b* is formed of a material that is different from those of the first spring 61*b* and the second spring 42*a* that come in contact with the power supply line 43*b*.

The electrical connection between the printed board 51 and the first spring 61*b* and the electrical connection between the first spring 61*b* and the power supply line 43*b* are both achieved by using elastic force of the first spring 61*b* that is a torsion coil spring. A contact pressure of about 1 N is created between the printed board 51 and the first spring 61*b* and between the first spring 61*b* and the power supply line 43*b* with the elastic force of the spring 61*b*.

The electrical connection between the power supply line 43*b* and the second spring 42*a* and the electrical connection between the second spring 42*a* and the electric contact 100*a*C2 are both achieved by using elastic force of the second spring 42*a* that is a compression spring. A contact pressure of about 1 N is created between the power supply line 43*b* and the second spring 42*a* and between the second spring 42*a* and the electric contact 100*a*C2 with the elastic force of the spring 42*a*.

A single power supply path illustrated in FIG. 5 is formed in each of the four cartridges 100.

Figure 6:
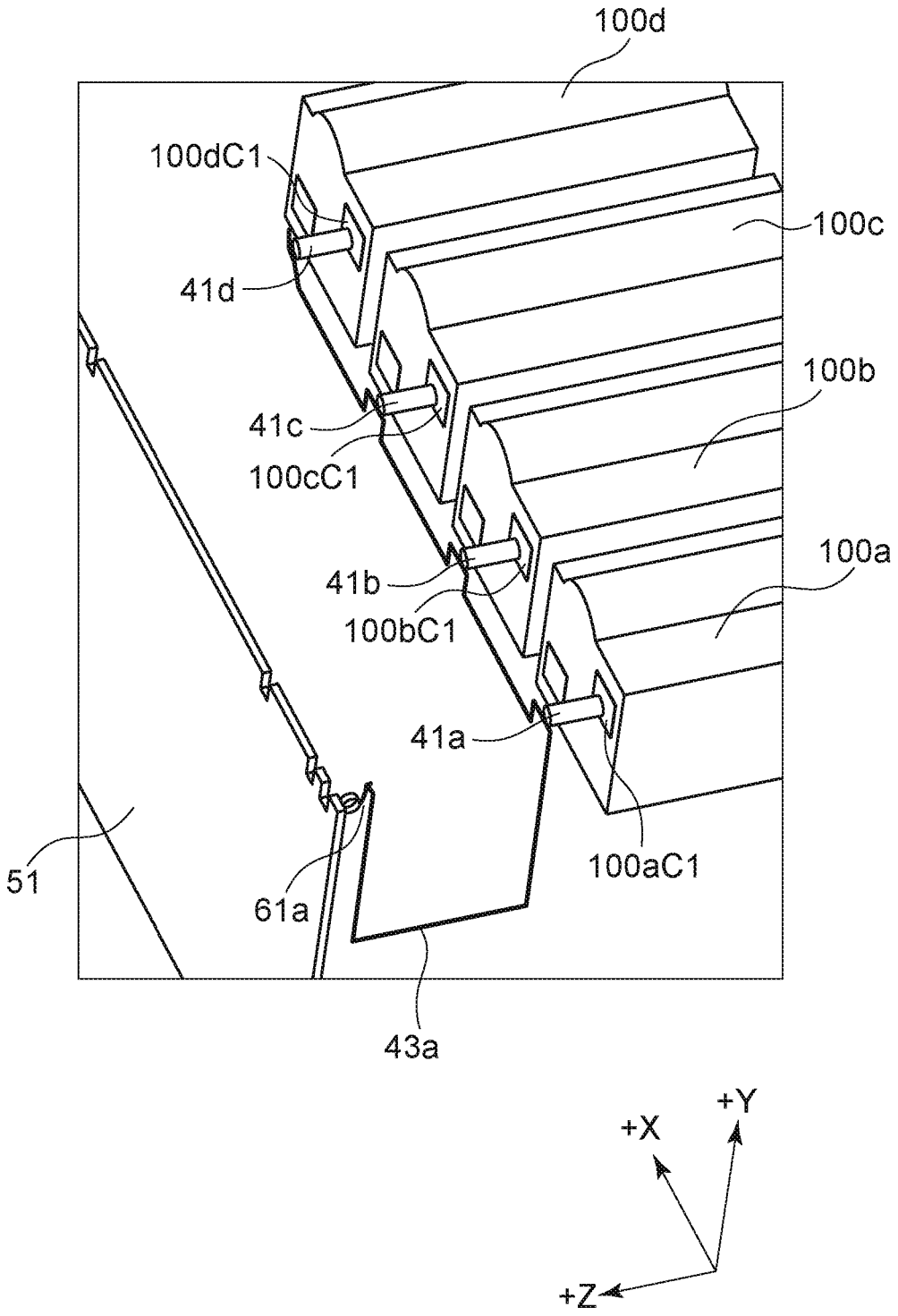
FIG. 6 is a diagram illustrating, among the plurality of power supply paths, another power supply path.

FIG. 6 is a diagram illustrating a power supply path that supplies power from the printed board 51 to the four cartridges 100 with a single power supply line 43*a*. The first spring 61*a* is in contact with one end of the power supply line 43*a*. Furthermore, the four second springs 41*a* to 41*d* are in contact with the power supply line 43*a*. Reference numerals 100*a*C1 to 100*d*C1 are each an electric contact provided in a corresponding one of the four cartridges 100. The material of the power supply line 43*a* and the materials of the first spring 61*a* and the second springs 41*a* to 41*d* are the same as those of the power supply line and the spring used in the power supply path illustrated in FIG. 5.

Figure 7:
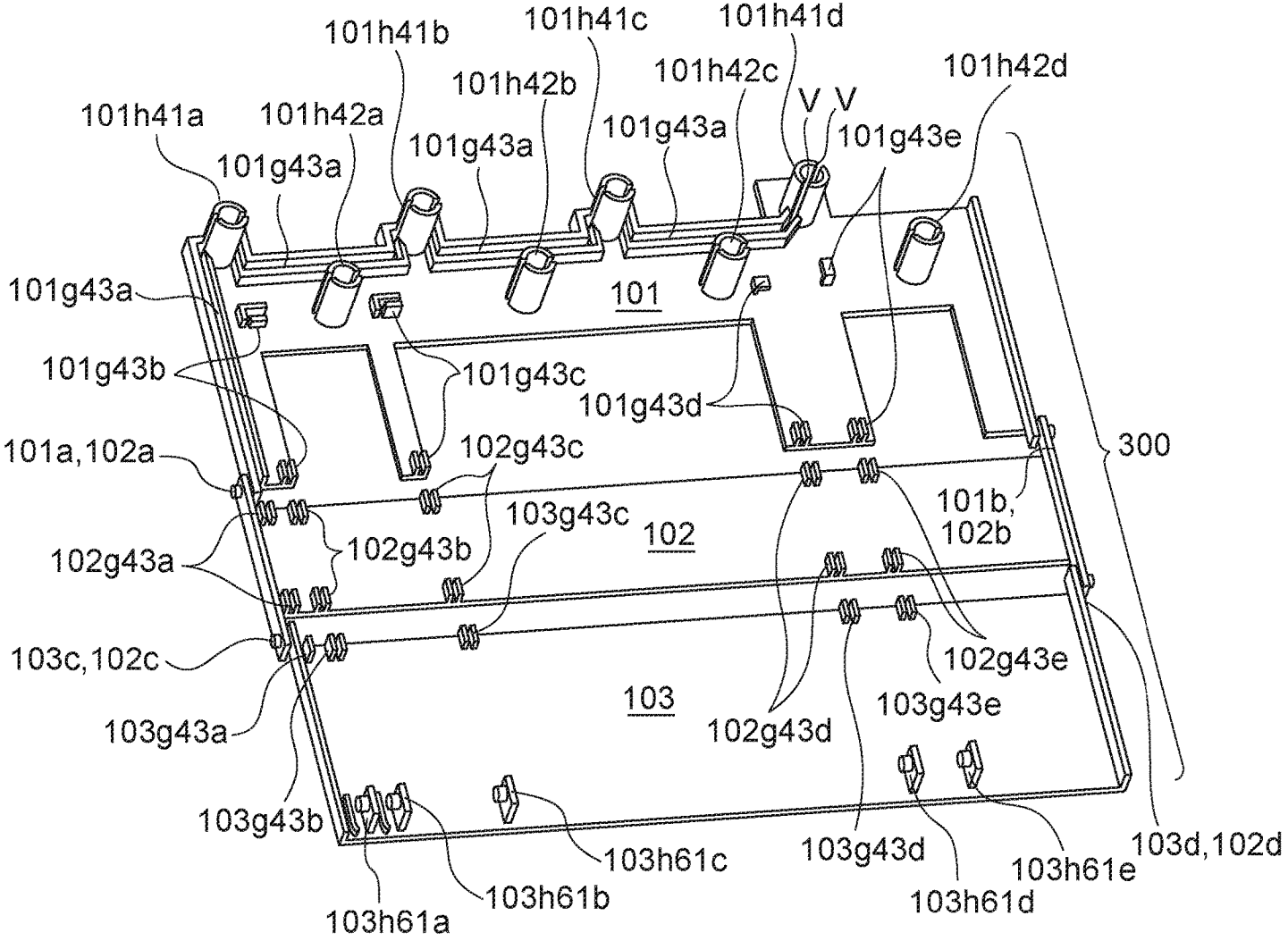
FIG. 7 is a perspective view of a holder that is in an open state.
Figure 8:
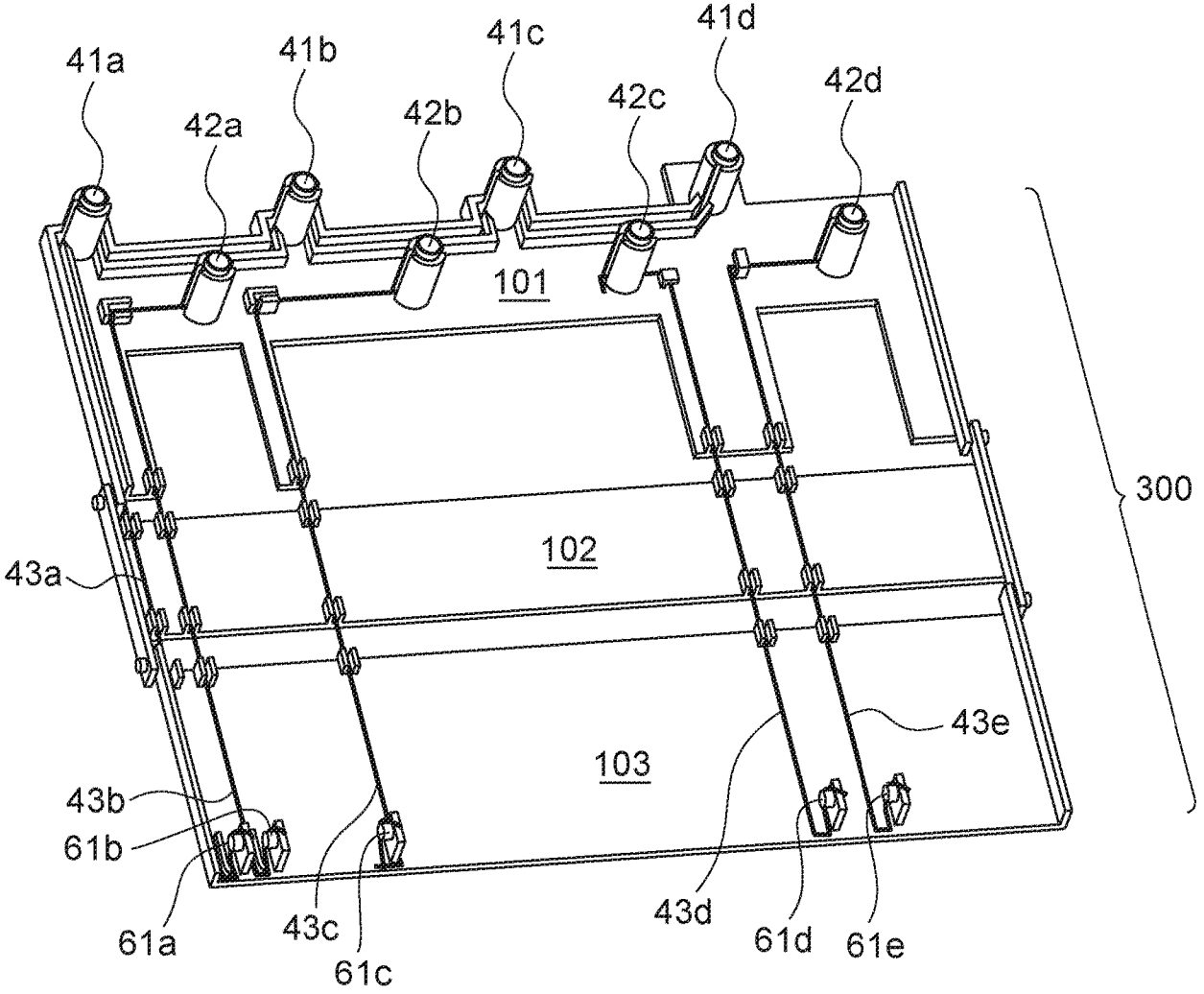
FIG. 8 is a perspective view illustrating a state in which power supply lines, and first and second springs are attached to the holder.

FIG. 7 is a development of the holder (a holding member) 300 that holds the power supply lines, the first springs, and the second springs. Furthermore, FIG. 8 illustrates a state in which the power supply lines, the first springs, and the second springs are attached to the holder 300. The above diagrams illustrate the holder 300 during the product production process. As described above, the power supply line employs a soft material. Accordingly, as illustrated in FIG. 7, it is easier to attach (wire) the power supply line while the holder 300 is open.

The holder 300 is a combination of three plates, namely, a plate 101, a plate 102, and a plate 103. As illustrated in FIG. 7, the entire plurality of plates can be developed into a substantially flat surface. Each plate is formed of an insulating resin. By having a boss 101*a* and a boss 101*b* of the plate 101 and a hole 102*a* and a hole 102*b* of the plate 102 be fitted to each other, the plate 101 and the plate 102 are attached to each other so as to be pivotal with respect to each other about the bosses. By having a boss 103*c* and a boss 103*d* of the plate 103 and a hole 102*c* and a hole 102*d* of the plate 102 be fitted to each other, the plate 102 and the plate 103 are attached to each other so as to be pivotal with respect to each other about the bosses. As described above, holder 300 is configured of a combination of the plurality of plates 101 to 103 that are provided in a pivotal manner with respect to each other.

Holding portions that hold the power supply lines, the first springs, and the second springs 41 are provided in each plate. The holding portions of the power supply line serve as guide portions as well. The power supply line 43*a* is held by a holding portion 101*g*43*a* provided on the plate 101, holding portions 102*g*43*a* provided on the plate 102, and a holding portion 103*g*43*a* provided on the plate 103. Furthermore, cylindrical holding portions 101*h*41*a*, 101*h*41*b*, 101*h*41*c*, and 101*h*41*d* (hereinafter, referred to as holding portions 101*h*41) that hold the second springs 41*a* to 41*d* that are in electrical contact with the power supply line 43*a* is provided on the plate 101. The second springs 41 that are compression springs are inserted into the cylinders of the holding portions 101*h*41 such that the helical axes of the springs are parallel to the generatrixes of the holding portions 101*h*41. Note that each holding portion is provided with two slits V. In FIG. 7, as a representative example, the reference signs V are only attached to the cylindrical holding portions 101*h*41*d*. The slits V are provided to insert the power supply line 43*a* therein. By inserting the second springs 41 into the cylindrical holding portions 101*h*41*d* after the power supply line 43*a* has been inserted along the slits V, the power supply line 43*a* and the second springs 41 come in contact with each other. A holding portion 103*h*61*a* that holds the first spring 61*a* that is a torsion coil spring is provided on the plate 103. By having the first spring 61*a* be held by the holding portion 103*h*61*a*, the power supply line 43*a* and the first spring 61*a* come in contact with each other.

The power supply line 43*b* is held by holding portions 101*g*43*b* provided on the plate 101, holding portions 102*g*43*b* provided on the plate 102, and a holding portion 103*g*43*b* provided on the plate 103. Furthermore, a cylindrical holding portion 101*h*42*a* that holds the second spring 42*a* that is electrically in contact with the power supply line 43*b* is provided on the plate 101. The second spring 42*a* that is a compression spring is inserted into the cylinder of the cylindrical holding portion 101*h*42*a* such that the helical axis of the spring 42 is parallel to the generatrix of the cylindrical holding portion 101*h*42*a*. Slits V similar to those of the cylindrical holding portion 101*h*41*d* are provided in the cylindrical holding portion 101*h*42*a* as well. By inserting the second spring 42*a* into the cylindrical holding portion 101*h*42*a* after the power supply line 43*b* has been inserted along the slits V, the power supply line 43*b* and the second spring 42*a* come in contact with each other. A holding portion 103*h*61*b* that holds the first spring 61*b* that is a torsion coil spring is provided on the plate 103. By having the first spring 61*b* be held by the holding portion 103*h*61*b*, the power supply line 43*b* and the first spring 61*b* come in contact with each other.

The power supply line 43*c* is held by holding portions 101*g*43*c* provided on the plate 101, holding portions 102*g*43*c* provided on the plate 102, and a holding portion 103*g*43*c* provided on the plate 103. Furthermore, a cylindrical holding portion 101*h*42*b* that holds the second spring 42*b* that is electrically in contact with the power supply line 43*c* is provided on the plate 101. The second spring 42*b* that is a compression spring is inserted into the cylinder of the cylindrical holding portion 101*h*42*b* such that the helical axis of the spring 42*b* is parallel to the generatrix of the cylindrical holding portion 101*h*42*b*. Slits V similar to those of the cylindrical holding portion 101*h*41*d* are provided in the cylindrical holding portion 101*h*42*b* as well. By inserting the second spring 42*b* into the cylindrical holding portion 101*h*42*b* after the power supply line 43*c* has been inserted along the slits V, the power supply line 43*c* and the second spring 42*b* come in contact with each other. A holding portion 103*h*61*c* that holds the first spring 61*c* that is a torsion coil spring is provided on the plate 103. By having the first spring 61*c* be held by the holding portion 103*h*61*c*, the power supply line 43*c* and the first spring 61*c* come in contact with each other.

The power supply line 43*d* is held by holding portions 101*g*43*d* provided on the plate 101, holding portions 102*g*43*d* provided on the plate 102, and a holding portion 103*g*43*d* provided on the plate 103. Furthermore, a cylindrical holding portion 101*h*42*c* that holds the second spring 42*c* that is electrically in contact with the power supply line 43*d* is provided on the plate 101. The second spring 42*c* that is a compression spring is inserted into the cylinder of the cylindrical holding portion 101*h*42*c* such that the helical axis of the spring is parallel to the generatrix of the cylindrical holding portion 101*h*42*c*. Slits V similar to those of the cylindrical holding portion 101*h*41*d* are provided in the cylindrical holding portion 101*h*42*c* as well. By inserting the second spring 42*c* into the holding portion cylindrical 101*h*42*c* after the power supply line 43*d* has been inserted along the slits, the power supply line 43*d* and the second spring 42*c* come in contact with each other. A holding portion 103*h*61*d* that holds the first spring 61*d* that is a torsion coil spring is provided on the plate 103. By having the first spring 61*d* be held by the holding portion 103*h*61*d*, the power supply line 43*d* and the first spring 61*d* come in contact with each other.

The power supply line 43*e* is held by holding portions 101*g*43*e* provided on the plate 101, holding portions 102*g*43*e* provided on the plate 102, and a holding portion 103*g*43*e* provided on the plate 103. Furthermore, a cylindrical holding portion 101*h*42*d* that holds the second spring 42*d* that is electrically in contact with the power supply line 43*e* is provided on the plate 101. The second spring 42*d* that is a compression spring is inserted into the cylinder of the cylindrical holding portion 101*h*42*d* such that the helical axis of the spring 42*d* is parallel to the generatrix of the cylindrical holding portion 101*h*42*d*. Slits V similar to those of the cylindrical holding portion 101*h*41*d* are provided in the cylindrical holding portion 101*h*42*d* as well. By inserting the second spring 42*d* into the cylindrical holding portion 101*h*42*d* after the power supply line 43*e* has been inserted along the slits V, the power supply line 43*e* and the second spring 42*d* come in contact with each other. A holding portion 103*h*61*e* that holds the first spring 61*e* that is a torsion coil spring is provided on the plate 103. By having the first spring 61*e* be held by the holding portion 103*h*61*e*, the power supply line 43*e* and the first spring 61*e* come in contact with each other. As described above, the power supply lines (conductive members) 43 are provided so as to extend across the plurality of plates.

Furthermore, FIG. 8 illustrates a state in which the power supply lines, and the first and second springs are attached to the holder 300. As described above, since wiring is performed using a soft power supply line such as a solder plating annealed copper wire, as illustrated in FIG. 8, even if the shapes of the power supply path are each different, power supply lines with different shapes do not have to be prepared for each of the power supply path.

Figure 9:
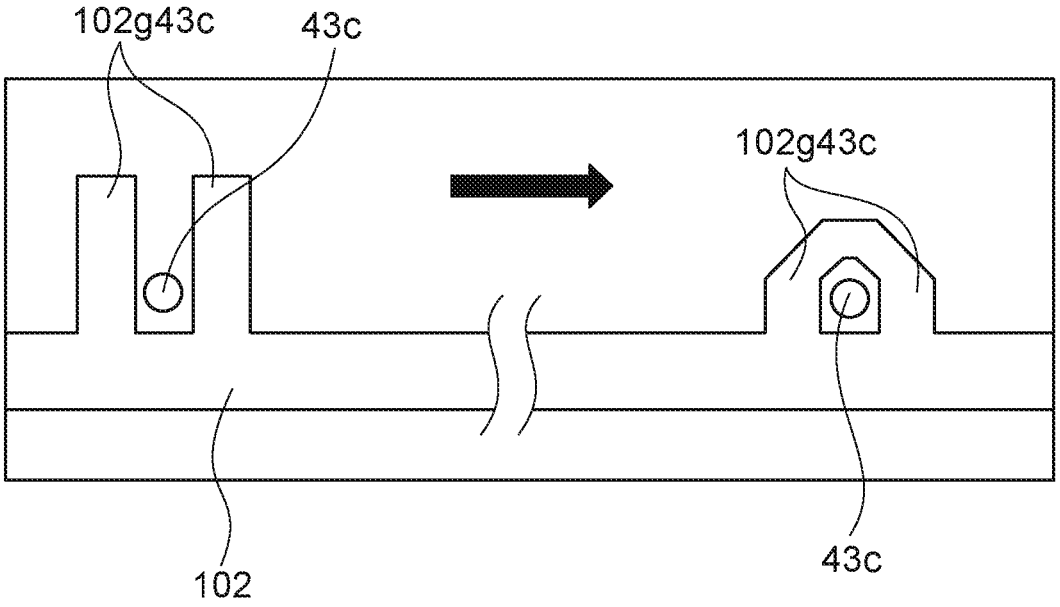
FIG. 9 is a cross-sectional view for describing a state in which a holding portion of a holder has been melted.

FIG. 9 is a cross sectional view for describing a state in which a holding portion of the holder 300 formed of resin has been melted so that the power supply line does not become dislocated from the holding portion. The left side in FIG. 9 illustrates a state before the holding portion is melted and the right side illustrates a state after the holding portion has been melted. After the power supply line 43*c* has been wired in the holding portion 102*g*43*c*, by melting the holding portion 102*g*43*c*, the power supply line 43*c* can be made not to become dislocated from the holder 300. In the present diagram, while a representative example will be described with the holding portion 102*g*43*c*, the other holding portions that hold the power supply line 43*c* and the other holding portions that hold the other power supply lines are desirably melted in a similar manner to prevent the power supply lines from becoming dislocated from the holder 300. In particular, since the power supply lines become easily dislocated from the holding portions when the holder 300 is folded, desirably, the holding portions provided on the plate 102, where the pivotal center exists, and near the plate 102 are melted so that dislocation of the power supply lines are stopped. The method of melting the holding portions that may be selected, as appropriate, include applying heat to the holding portions, and applying an ultrasonic wave to the holding portions. Furthermore, the power supply lines may be made difficult to dislocate by bending or curling the end portions of the power supply lines so as to be hooked to the holding portions.

Figure 10:
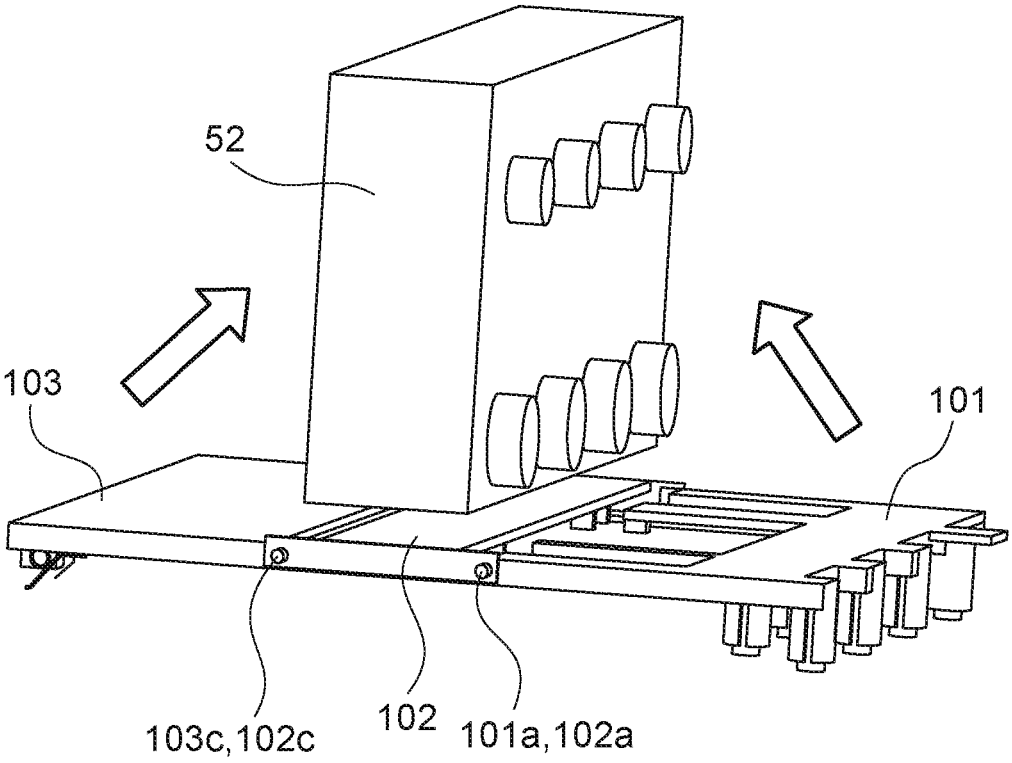
FIG. 10 is a diagram illustrating a state immediately before the holder is attached to a drive unit.

In the product production process, a state illustrated in FIG. 4 is reached by folding the holder 300 in which, as in FIG. 8, the power supply lines and the first and second springs are attached and, further, as in FIG. 9, in which the dislocation of the power supply line is stopped, such that the holder 300 surrounds the drive unit 52, as illustrated in FIG. 10. FIG. 10 is a diagram illustrating a state immediately before the holder 300 is attached to the drive unit 52. When the holder 300 is attached to the drive unit 52, the holder 300 is folded about the bosses, which connect each plate, into a U-shape such that a state illustrated in FIG. 4 is formed. The holder 300 and the drive unit 52 are installed in the main body 1 of the apparatus while in a state illustrated in FIG. 4. With such a configuration described above, the electrical connection between the power supply lines 43 and the first and second springs can be kept connected at all times even when the holder 300 is opened and closed to mount and dismount the drive unit 52; accordingly, the reliability of the electrical connections can be increased.

As illustrated in FIGS. 7 and 8, when the power supply lines 43 are attached to the holder 300, the power supply lines 43 are installed by being bent and curved along the holding portions provided on the holder 300. The power supply lines 43 are wires that are commercially sold, such as solder plating annealed copper wires that are soft and that have small elastic force, without any insulating covers. Such power supply lines 43 are attached to the holder 300 by being bent and curved along the holding portions provided on the holder 300.

It will be difficult to extend the power supply lines along the holding portions if wiring were to be performed using power supply lines with high rigidity. Furthermore, if wires such as spring materials with large elastic force were to be used as the power supply lines, the power supply lines wired along the holding portions of the holder 300 will try to return to its original shape. Accordingly, it will be difficult to keep the power supply lines extend along the holding portions. Accordingly, in order to hold the power supply lines along random guide shapes, desirably, the power supply lines are formed of a material with a low elastic coefficient, a material with low yield stress, or a material with small yield strength.

Meanwhile, in a case in which the first springs 61 and the second springs 41 are fabricated with a material that is the same as that of the power supply lines, the sizes of the springs need to be large in order to obtain the desired contact pressure; accordingly, in actuality, it is difficult to dispose such large springs inside the apparatus. Furthermore, the yield stress is small and plastic deformation occurs; accordingly, in actuality, it is difficult to use such springs as the springs. As described above, in the present exemplary embodiment, the power supply lines (the conductive members) are, compared with the springs (elastic members) at the end portions of the power supply lines, formed of a material with a low elastic coefficient, a material with low yield stress, or a material with low yield strength.

Since the power supply lines are formed of a soft wire with small elastic force, compared with a case using a high-voltage cable in which the surface is covered by an insulating tube, the cost of the power supply line can be reduced. Furthermore, in a case illustrated in FIG. 3 in which there are a plurality of power supply paths, since the power supply paths can be formed using soft power supply lines that can be easily deformed, there is no need to prepare a steel material with a different shape in each path. Accordingly, there is no increase in the number of types of components. Furthermore, there is no need to do sorting work to prevent steel materials with different shapes from becoming mixed.

Furthermore, in the present exemplary embodiment, the power supply lines 43 are formed of a soft wire with small elastic force; accordingly, even when the holder 300 is folded about the bosses into a U-shape illustrated in FIG. 4, the holder 300 does not return to its original state illustrated in FIG. 8 by elastic force and does not easily become snapped.

As described above, the holder 300 is formed of an insulating resin. The holding portions provided on the holder serves to prevent the plurality of power supply lines 43 from coming into contact with each other. Other than the above function, the holding portions also serve to insulate the drive unit 52 and the power supply lines 43 from each other so that the drive unit 52 and the power supply lines 43 do not become electrically connected to each other in a case in which the drive unit 52 is formed of conductive metal.

Note that in the present exemplary embodiment, the first and second springs have been provided at both ends of the power supply lines; however, only one of the end portions may be provided with the spring and each power supply line may be formed of a material that is softer than the above spring.

Furthermore, in the present exemplary embodiment, the first springs 61 are torsion coil springs, and the second springs 41 and 42 are compression springs; however, the springs may be any spring that has elastic force such as a tension spring, and both the first and second springs may be compression springs.

Furthermore, in the present exemplary embodiment, the springs are in direct contact with the two ends of the power supply lines 43. However, a rigid body such as a washer or the like may be interposed between the power supply line 43, and the first springs and the second springs while the power supply line 43 is formed of a material that is softer than the first springs and the second springs.

As in the present exemplary embodiment, by having the power supply lines (the conductive members) be formed of a material with a low elastic coefficient, a material with low yield stress, or a material with low yield strength compared with those of the first and second springs (the elastic members), the cost of the component and the cost for assembling caused by sorting work can be reduced.

Second Exemplary Embodiment

A second exemplary embodiment will be described with reference to FIGS. 11 to 14. The image forming apparatus uses elastic members and conductive members that are softer than the elastic members in the power supply paths to the primary transfer rollers 7 that are transfer members described in the first exemplary embodiment.

Figure 11:
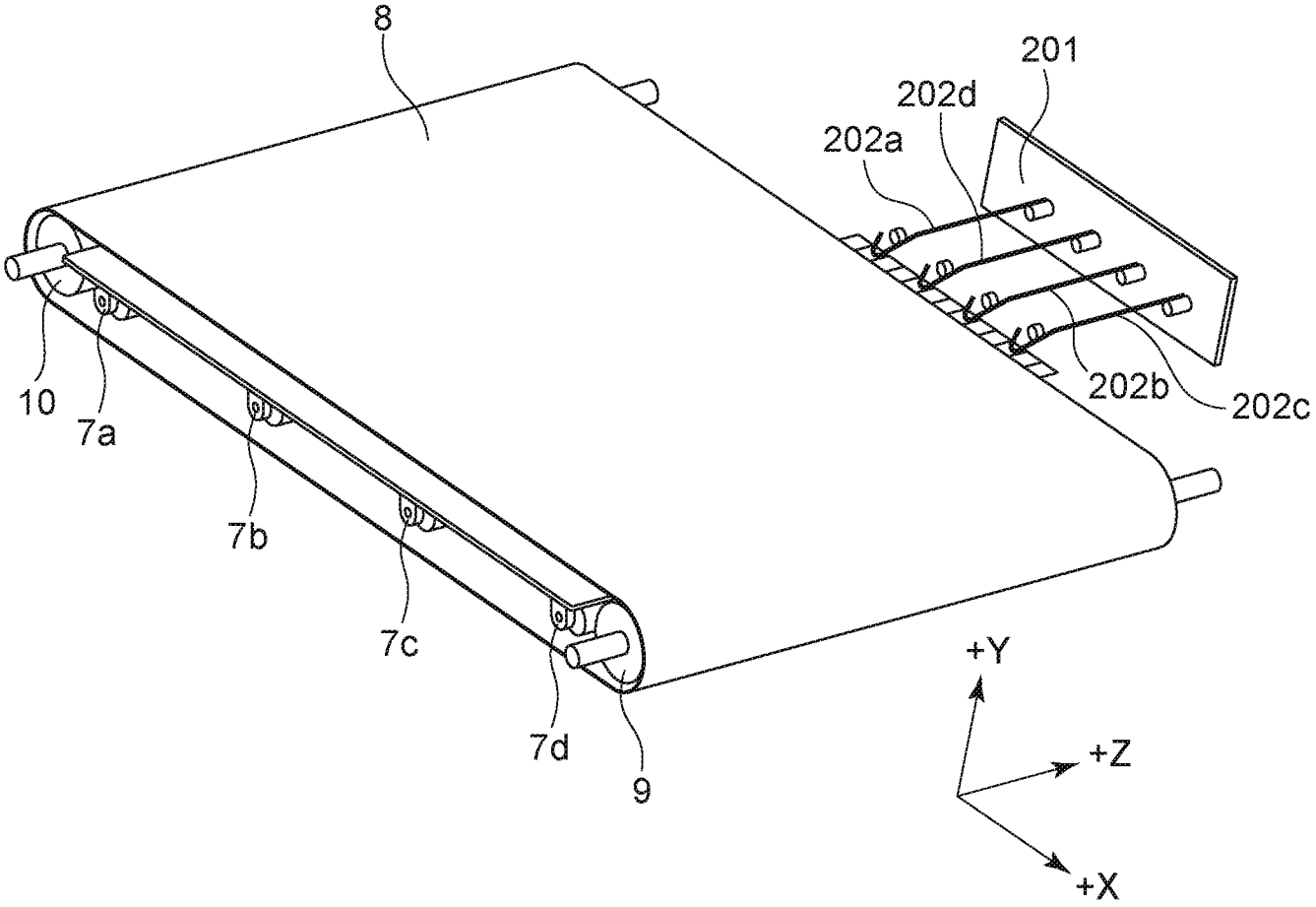
FIG. 11 is a perspective view illustrating power supply paths to the primary transfer rollers.
Figure 12:
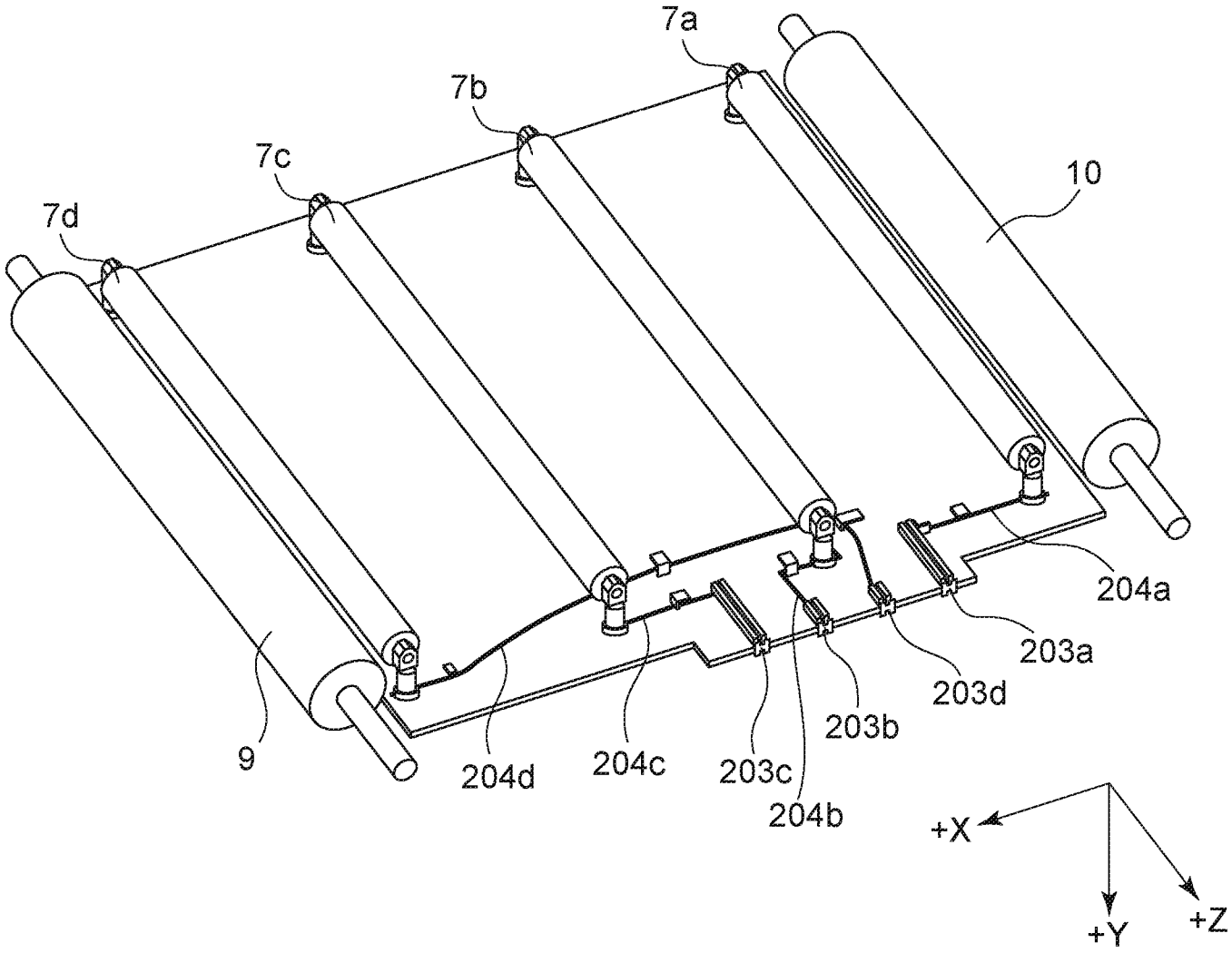
FIG. 12 is a diagram of an inside of a transfer unit viewed from an underside of the transfer unit.

FIG. 11 is a perspective view illustrating the power supply paths to the primary transfer rollers 7. FIG. 12 is a diagram of the inside of the transfer unit viewed from the underside without illustrating some of the components, such as the intermediate transfer belt 8.

First springs 202*a*, 202*b*, 202*c*, and 202*d* (hereinafter, referred to as first springs 202) that are elastic members are provided in the power supply paths between a printed board 201 that is a connected object and that is a high voltage power supply board, and the primary transfer rollers 7 that are connected objects. Furthermore, power feeding plates 203*a*, 203*b*, 203*c*, and 203*d* (hereinafter, referred to as power feeding plates 203), and power supply lines 204*a*, 204*b*, 204*c*, and 204*d* (hereinafter, referred to as power supply lines 204) that are conductive members are provided. Furthermore, second springs 205 that are elastic members, and bearings 206 of the primary transfer rollers 7 are provided. Accordingly, supply of power to the primary transfer rollers 7 is performed through the first springs 202, the power feeding plates 203, the power supply lines 204, the second springs 205, and the bearings 206.

The first springs 202, the power feeding plates 203, the power supply lines 204, the second springs 205, and the bearings 206 are all formed of an electrically conductive material. The materials of the first springs 202 and the second springs 205 are, similar to the first exemplary embodiment, a wire (a spring steel material, a piano wire, or a stainless steel wire that has a Young's modulus of about 200 GPa, for example) that has a high elastic coefficient and that is generally called a spring material. Meanwhile, the material of the power supply lines 204 is a wire that has no insulating cover, and that is formed of a soft material having a low elastic coefficient (a solder plating annealed copper wire having a Young's modulus of about 100 GPa, for example), and different materials are used for the first and second springs. The power supply lines 204 are disposed so as to be bent and curved in the paths between the power feeding plates 203 and the second springs 205. The power feeding plates 203 are formed of metal plates (for example, stainless steel (SUS)), and are members that are harder than the power supply lines 204.

Figure 13:
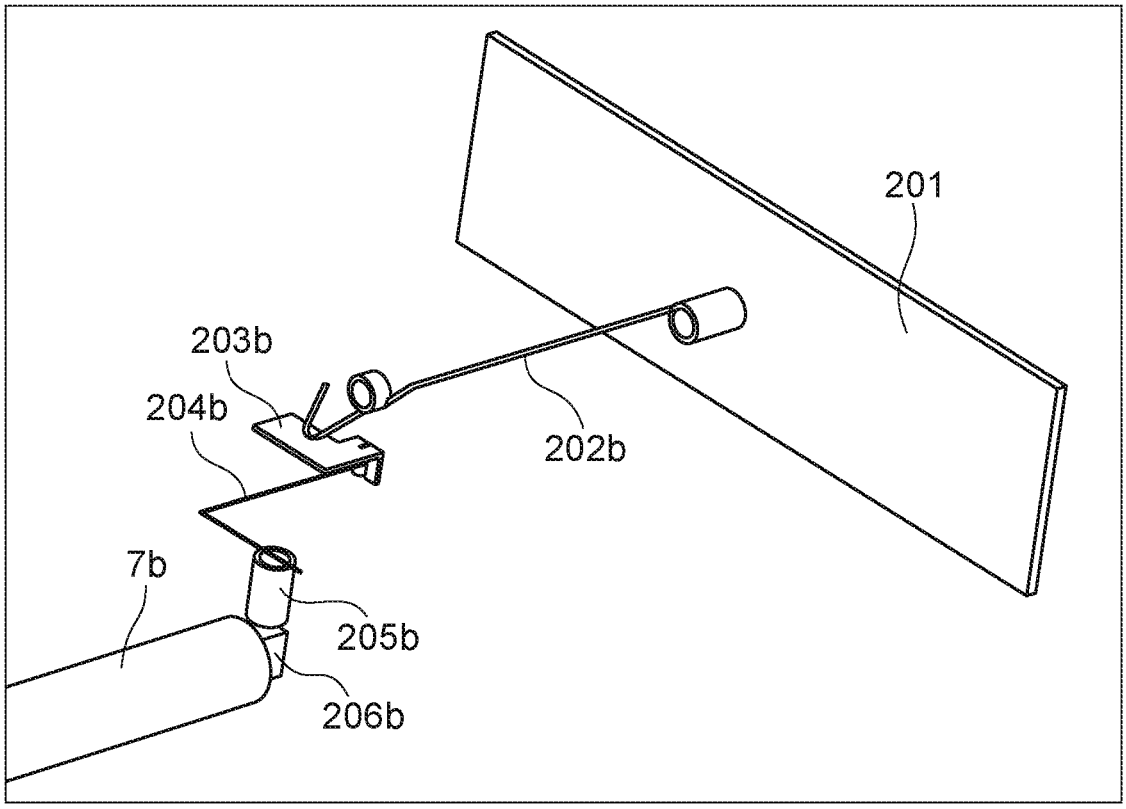
FIG. 13 is a diagram illustrating one of the power supply paths to the primary transfer roller.
Figure 14:
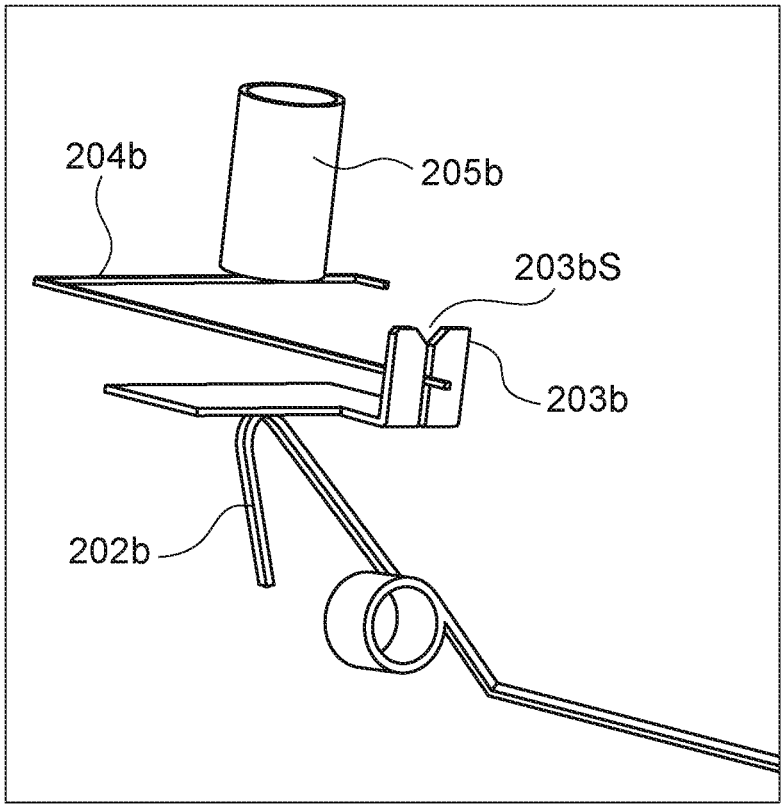
FIG. 14 is a diagram in which a portion of FIG. 13 has been enlarged.

FIG. 13 is a diagram in which one of the power supply paths to the primary transfer rollers 7 has been selected. FIG. 14 is an enlarged view of the vicinity of the power supply line in FIG. 13 viewed from the underside.

The power supply line 204*b* is electrically coupled to the power feeding plate 203*b* by being press-fitted into a slit 203*b*S of the power feeding plate 203*b*. The electrical connection between the first spring 202*b* and the power feeding plate 203*b* is achieved by using the elastic force of the first spring 202*b* that is a torsion coil spring. The first spring 202*b* creates a contact pressure of about 1 N between the first spring 202*b* and the power feeding plate 203*b*. The electrical connection between the power supply line 204*b* and a second spring 205*b* is achieved by using the elastic force of the second spring 205*b* that is a compression spring. The second spring 205*b* creates a contact pressure of about 1 N between the power supply line 204*b* and the second spring 205*b*.

In the present exemplary embodiment, the power supply line 204*b* that is a conductive member is not in contact with the first spring 202*b* that is an elastic member but the power feeding plate 203*b* is in contact with the first spring 202*b*, and a separate member is interposed between the elastic member and the conductive member. However, even in such an exemplary embodiment as well, it is only sufficient that the power supply line 204*b* that is a conductive member is formed of a material with a low elastic coefficient, a material with low yield stress, or a material with low yield strength, compared with the first spring 202*b* that is an elastic member.

The present disclosure is capable of reducing the component cost and the assembling cost caused by sorting work.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus arranged to form an image on a recording material, the image forming apparatus comprising:

a first object;

a second object;

an electrically conductive wire;

a first urging member provided between the first object and the electrically conductive wire, the first urging member being arranged to urge the first object and the electrically conductive wire so as to separate from each other and to electrically couple the electrically conductive wire and the first object to each other; and a second urging member provided between the second object and the electrically conductive wire, the second urging member being arranged to urge the second object and the electrically conductive wire so as to separate from each other and to electrically couple the electrically conductive wire and the second object to each other, wherein the electrically conductive wire is formed of a material having an elastic coefficient that is lower than that of the first urging member and that of the second urging member.

2. The image forming apparatus according to claim 1, wherein the electrically conductive wire is a solder plating annealed copper wire.

3. The image forming apparatus according to claim 1, further comprising an electrically insulating holder including a wire holding portion for holding the electrically conductive wire, wherein the wire holding portion is arranged such that a circumference of the electrically conductive wire is surrounded by the wire holding portion, and the electrically conductive wire is attached to the electrically insulating holder.

4. The image forming apparatus according to claim 3, wherein the first urging member and the second urging member are torsion springs, wherein the electrically insulating holder includes cylindrical holding portions into which the torsion springs are inserted, and each of the cylindrical holding portions includes a slit into which a part of the electrically conductive wire is inserted, and wherein, by inserting the torsion spring into the cylindrical holding portion after the electrically conductive wire has been inserted along the slit, the electrically conductive wire and the torsion spring come in contact with each other.

5. The image forming apparatus according to claim 1, wherein the first object is a high voltage power supply board.

6. The image forming apparatus according to claim 5, wherein the second object is a process cartridge in which process members needed to form an image are formed into a unit.

7. The image forming apparatus according to claim 5, wherein the image forming apparatus includes a photosensitive member, and a transfer member arranged to transfer an image formed on the photosensitive member, and wherein the second object is the transfer member.

8. An image forming apparatus arranged to form an image on a recording material, the image forming apparatus comprising:

a first object;

a second object;

an electrically conductive wire;

a first urging member provided between the first object and the electrically conductive wire, the first urging member being arranged to urge the first object and the electrically conductive wire so as the separate from each other and to electrically couple the electrically conductive wire and the first object to each other; and a second urging member provided between the second object and the electrically conductive wire, the second urging member being arranged to urge the second object and the electrically conductive wire so as to separate from each other and to electrically couple the electrically conductive wire and the second object to each other, wherein the electrically conductive wire is formed of a material having a yield stress that is lower than that of the first urging member and that of the second urging member.

9. The image forming apparatus according to claim 8, wherein the electrically conductive wire is a solder plating annealed copper wire.

10. The image forming apparatus according to claim 8, further comprising an electrically insulating holder including a wire holding portion for holding the electrically conductive wire, wherein the wire holding portion is arranged such that a circumference of the electrically conductive wire is surrounded by the wire holding portion, and the electrically conductive wire is attached to the electrically insulating holder.

11. The image forming apparatus according to claim 10, wherein the first urging member and the second urging member are torsion springs, wherein the electrically insulating holder includes cylindrical holding portions into which the torsion springs are inserted, and each of the cylindrical holding portions includes a slit into which a part of the electrically conductive wire is inserted, and wherein, by inserting the torsion spring into the cylindrical holding portion after the electrically conductive wire has been inserted along the slit, the electrically conductive wire and the torsion spring come in contact with each other.

12. The image forming apparatus according to claim 8, wherein the first object is a high voltage power supply board.

13. The image forming apparatus according to claim 12, wherein the second object is a process cartridge in which process members needed to form an image are formed into a unit.

14. The image forming apparatus according to claim 12, wherein the image forming apparatus includes a photosensitive member, and a transfer member arranged to transfer an image formed on the photosensitive member, and wherein the second object is the transfer member.

15. An image forming apparatus arranged to form an image on a recording material, the image forming apparatus comprising:

a first object;

a second object;

an electrically conductive wire; and a first urging member provided between the first object and the electrically conductive wire, the first urging member being arranged to urge the first object and the electrically conductive wire so as to separate from each other and to electrically couple the electrically conductive wire and the first object to each other; and a second urging member provided between the second object and the electrically conductive wire, the second urging member being arranged to urge the second object and the electrically conductive wire so as to separate from each other and to electrically couple the electrically conductive wire and the second object to each other, wherein the electrically conductive wire is formed of a material having a yield strength that is lower than that of the first urging member and that of the second urging member.

16. The image forming apparatus according to claim 15, wherein the electrically conductive wire is a solder plating annealed copper wire.

17. The image forming apparatus according to claim 15, further comprising an electrically insulating holder including a wire holding portion for holding the electrically conductive wire, wherein the wire holding portion is arranged such that a circumference of the electrically conductive wire is surrounded by the wire holding portion, and the electrically conductive wire is attached to the electrically insulating holder.

18. The image forming apparatus according to claim 17, wherein the first urging member and the second urging member are torsion springs, wherein the electrically insulating holder includes cylindrical holding portions into which the torsion springs are inserted, and each of the cylindrical holding portions includes a slit into which a part of the electrically conductive wire is inserted, and wherein, by inserting the torsion spring into the cylindrical holding portion after the electrically conductive wire has been inserted along the slit, the electrically conductive wire and the torsion spring come in contact with each other.

19. The image forming apparatus according to claim 15, wherein the first object is a high voltage power supply board.

20. The image forming apparatus according to claim 19, wherein the second object is a process cartridge in which process members needed to form an image are formed into a unit.

21. The image forming apparatus according to claim 19, wherein the image forming apparatus includes a photosensitive member, and a transfer member arranged to transfer an image formed on the photosensitive member, and wherein the second object is the transfer member.

* * * * *